US010975650B2

(12) United States Patent
Holodnak et al.

(10) Patent No.: US 10,975,650 B2
(45) Date of Patent: Apr. 13, 2021

(54) ELECTRONIC RELEASE TOOL

(71) Applicant: Hunting Titan, Inc., Pampa, TX (US)

(72) Inventors: John D. Holodnak, Spring, TX (US); Garrett M. Hohmann, Houston, TX (US); Santos D. Ortiz, Houston, TX (US); Gene McBride, Houston, TX (US); Sridhar Rajaram, Houston, TX (US); George King, Richmond, TX (US)

(73) Assignee: Hunting Titan, Inc., Pampa, TX (US)

( * ) Notice: Subject to any disclaimer, the term of this patent is extended or adjusted under 35 U.S.C. 154(b) by 0 days.

(21) Appl. No.: 16/466,965

(22) PCT Filed: Dec. 14, 2017

(86) PCT No.: PCT/US2017/066323

§ 371 (c)(1),
(2) Date: Jun. 5, 2019

(87) PCT Pub. No.: WO2018/112153

PCT Pub. Date: Jun. 21, 2018

(65) Prior Publication Data

US 2019/0338612 A1 Nov. 7, 2019

Related U.S. Application Data

(60) Provisional application No. 62/435,583, filed on Dec. 16, 2016, provisional application No. 62/462,826,
(Continued)

(51) Int. Cl.
*E21B 31/18* (2006.01)
*E21B 31/20* (2006.01)
(Continued)

(52) U.S. Cl.
CPC ..... *E21B 31/18* (2013.01); *E21B 31/20* (2013.01); *E21B 7/122* (2013.01); *E21B 17/06* (2013.01);
(Continued)

(58) Field of Classification Search
CPC ..... E21B 17/06; E21B 31/00; E21B 31/107
See application file for complete search history.

(56) References Cited

U.S. PATENT DOCUMENTS 1,315,581 A 9/1919 Scott
3,503,444 A 3/1970 Owen
(Continued)

FOREIGN PATENT DOCUMENTS

CN 104179470 A 12/2014
EP 0552087 A2 7/1993
(Continued)

OTHER PUBLICATIONS

Notification of Transmittal of the International Search Report and the Written Opinion of the International Searching Authority, PCT Application No. PCT/US17/66323, dated Feb. 21, 2018, 10 pages.
(Continued)

*Primary Examiner* — Tara Schimpf
(74) *Attorney, Agent, or Firm* — Jason Saunders; Christopher McKeon; Arnold & Saunders, LLP

(57) ABSTRACT

A releasable tool using an electronic motor to drive a collet and associated collet arms to engage or release a quick change sub that may be coupled to additional downhole tools, such as a perforating gun string.

22 Claims, 4 Drawing Sheets

Related U.S. Application Data filed on Feb. 23, 2017, provisional application No. 62/515,376, filed on Jun. 5, 2017.

(51) Int. Cl.

| | |
|---|---|
| *E21B 7/12* | (2006.01) |
| *E21B 17/06* | (2006.01) |
| *E21B 33/129* | (2006.01) |
| *E21B 33/1295* | (2006.01) |

(52) U.S. Cl.

CPC ..... *E21B 33/1294* (2013.01); *E21B 33/1295* (2013.01)

(56) References Cited

U.S. PATENT DOCUMENTS

| | | | | |
|---|---|---|---|---|
| 3,603,388 | A | 9/1971 | Current et al. | |
| 6,032,733 | A * | 3/2000 | Ludwig | E21B 17/023 166/60 |
| 6,848,506 | B1 | 2/2005 | Sharp et al. | |

FOREIGN PATENT DOCUMENTS

| | | | |
|---|---|---|---|
| EP | 0898046 | A2 | 2/1999 |
| EP | 2381063 | A2 | 10/2011 |
| RU | 2241109 | A1 | 11/2004 |
| RU | 2241109 | C2 | 11/2004 |
| WO | 2014185912 | A1 | 11/2014 |

OTHER PUBLICATIONS

Extended European Search Report dated Aug. 11, 2020, EP application No. 1788005.1, 5 pages.

Canadian office action dated Jun. 16, 2020, CA application No. 3,046,970, 4 pages.

* cited by examiner

ELECTRONIC RELEASE TOOL

RELATED APPLICATIONS

This application claims priority to U.S. Provisional Application No. 62/435,583, filed Dec. 16, 2016.

BACKGROUND OF THE INVENTION

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically a wellbore will be drilled from a surface location, placing a hole into a formation of interest. Completion equipment will be put into place, including casing, tubing, and other downhole equipment as needed. Perforating the casing and the formation with a perforating gun is a well known method in the art for accessing hydrocarbon deposits within a formation from a wellbore.

Explosively perforating the formation using a shaped charge is a widely known method for completing an oil well. A shaped charge is a term of art for a device that when detonated generates a focused explosive output. This is achieved in part by the geometry of the explosive in conjunction with an adjacent liner. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates the liner metal is compressed into a super-heated, super pressurized jet that can penetrate metal, concrete, and rock. Perforating charges are typically used in groups. These groups of perforating charges are typically held together in an assembly called a perforating gun. Perforating guns come in many styles, such as strip guns, capsule guns, port plug guns, and expendable hollow carrier guns.

Perforating charges are typically detonated by detonating cord in proximity to a priming hole at the apex of each charge case. Typically, the detonating cord terminates proximate to the ends of the perforating gun. In this arrangement, a detonator at one end of the perforating gun can detonate all of the perforating charges in the gun and continue a ballistic transfer to the opposite end of the gun. In this fashion, numerous perforating guns can be connected end to end with a single detonator detonating all of them.

The detonating cord is typically detonated by a detonator triggered by a firing head. The firing head can be actuated in many ways, including but not limited to electronically, hydraulically, and mechanically.

Expendable hollow carrier perforating guns are typically manufactured from standard sizes of steel pipe with a box end having internal/female threads at each end. Pin ended adapters, or subs, having male/external threads are threaded one or both ends of the gun. These subs can connect perforating guns together, connect perforating guns to other tools such as setting tools and collar locators, and connect firing heads to perforating guns. Subs often house electronic, mechanical, or ballistic components used to activate or otherwise control perforating guns and other components.

Perforating guns typically have a cylindrical gun body and a charge tube, or loading tube that holds the perforating charges. The gun body typically is composed of metal and is cylindrical in shape. Within a typical gun tube is a charge holder designed to hold the shaped charges. Charge holders can be formed as tubes, strips, or chains. The charge holder will contain cutouts called charge holes to house the shaped charges.

Many perforating guns are electrically activated. This requires electrical wiring to at least the firing head for the perforating gun. In many cases, perforating guns are run into the well in strings where guns are activated either singly or in groups, often separate from the activation of other tools in the string, such as setting tools. In these cases, electrical communication must be able to pass through one perforating gun to other tools in the string. Typically, this involves threading at least one wire through the interior of the perforating gun and using the gun body as a ground wire.

Perforating guns and other tools are often connected lowered or conveyed downhole while connected to the surface using a wireline. When pulling the tool back to the surface the tool string may get stuck in the borehole. If too much tension is introduced to the wireline it may fail with a part of the cable falling back into the borehole. Then a fishing tool must be used to grab the loose wireline and pull it back out. This may cause further failures and requires more use of a fishing tool. All of the wireline must be removed before a retrieval tool, such as an overshot style or wash-over style tool, can be used to pull the gun string out itself. This procedure of fishing out the tool may be costly and requires extensive time at the wellsite along with specialized tools.

Releasable tools currently in use may include explosive tools, which use a small booster type explosive to shear a neck, and shear bolts that fail at a predesigned point to allow the wireline to be pulled out of the well intact when a tool string is stuck. Issues with explosive tools may include regulatory issues, transportation issues with the explosive, and the safety concerns of having to pull a live explosive from the wellbore every time the tool string is brought to the surface. Issues with shear bolts is that they may not always fail as designed and an expensive tool may be unnecessarily lost or stuck in the wellbore as a result, or the wireline may still fail because the shear bolts do not function properly.

SUMMARY OF EXAMPLE EMBODIMENTS

An example embodiment may include an apparatus for joining and releasing downhole tools having a first cylindrical portion housing a motor coupled to a super nut, wherein the super nut converts rotation motion into a set linear travel from a first stop to a second stop, an indicator switch coupled to the super nut, wherein the indicator switch can detect if the super nut has reached the first stop or the second stop, a second cylindrical portion located downhole of, and proximate to, the first cylindrical portion housing a push rod coupled to a collet, wherein the push rod is further coupled to the super nut, the collet further comprising a first conical portion and a second conical portion connected by a cylindrical body, wherein the slant of the first conical portion and the second conical portion face towards each other, at least one collet arm pivoting about a pin located within the second cylindrical body and having a rocker arm with a first contact area, a second contact area, and a lever grip, in which the first contact area is located proximate to the first conical portion, the second contact area is located proximate to the second conical portion, and the pivot point is located in between the first conical portion and a the second conical portion of the collet.

A variation of the example embodiment may include screw coupling the motor to the super nut. It may have a plurality of bearings on the screw. The at least one collet arm may be a plurality of collet arms located evenly about the center axis of the collet. It may include at least one collet cutout in the second cylindrical portion corresponding to the at least one collet arm. It may include a feed thru connector coupled to the second cylindrical portion and an umbilical electrical cord connected to feed thru connector. It may include a guide cutout with in the first cylindrical portion, having the first stop and second stop, for the indicator switch to travel along. It may include a third cylindrical portion that slides over the second cylindrical portion, having an umbilical cord slot and a plurality of pressure equalizing vents. The super nut may be restricted from rotating and is free to slide axially.

An example embodiment may include a release tool for use in tool strings in oil wells having a drive unit including a motor and a super nut adapted to translate the super nut axially in response to rotation of the motor, a collet assembly including a plurality of collet arms pivotably affixed to a collet housing and a tapered inner collet shaft, a sensor adapted to detect the position of the super nut at both extremities of its axial movement, in which the axial translation of the super nut translates the tapered inner collet shaft axially and the axial translation of the inner collet shaft in one direction opens the collet arms and in the other direction closes the collet arms. It may further include any or all of a screw coupling the motor to the super nut, a plurality of bearings on the screw, a collet housing encompassing the collet assembly, at least one collet cutout in the second cylindrical portion corresponding to the at least one collet arm, a detachable umbilical electrical cord passing proximate to the collet assembly, and a feed thru pin at each end of the umbilical electrical cord. The super nut may be a linear actuating nut that is restricted from rotating axial and free to move linearly. It may include a cylindrical outer housing that slides over the collet housing, having an umbilical cord slot and a plurality of pressure equalizing vents. It may include an indicator switch coupled to the super nut, in which the indicator switch can detect when the super nut has reached either of the axial extremities of its axial movement. The plurality of collet arms may further include at least one collet arm pivoting about a pin located within the second cylindrical body and having a rocker arm with a first contact area, a second contact area, and a lever grip at the end of the collet arm. The first contact area and the second contact area of the rocker arm shaped collet arm may be located proximate to, and mechanically engaged with the collet shaft.

An example embodiment may include an apparatus for joining and releasing downhole tools having a first cylindrical portion housing a linear actuator that provides linear actuation from a first stop to a second stop, an indicator switch coupled to the linear actuator, wherein the indicator switch can detect when the linear actuator has reached the first stop or the second stop, a second cylindrical portion located downhole of, and proximate to, the first cylindrical portion housing a push rod coupled to a collet, in which the push rod is further coupled to the super nut, the collet further including a first conical portion and a second conical portion connected by a cylindrical body, wherein the slant of the first conical portion and the second conical portion face towards each other, at least one collet arm pivoting about a pin located within the second cylindrical body and having a rocker arm with a first contact area, a second contact area, and a lever grip, in which the first contact area is located proximate to the first conical portion, the second contact area is located proximate to the second conical portion, and the pivot point is located in between the first conical portion and a the second conical portion of the collet.

A variation of the example embodiment may include a screw coupling the motor to the super nut and a plurality of bearings on the screw. The at least one collet arm may be a plurality of collet arms located evenly about the center axis of the collet. It may include at least one collet cutout in the second cylindrical portion corresponding to the at least one collet arm. It may include an umbilical electrical cord connected to the second cylindrical portion using a feed thru connector. It may include a guide slot in the first cylindrical portion for the indicator switch to travel along. It may include a third cylindrical portion that slides over the second cylindrical portion, having an umbilical cord slot and a plurality of pressure equalizing vents. The linear actuator may include a motor coupled to a super nut, in which the super nut converts rotation motion into a linear travel.

An example embodiment may include a method for joining and releasing downhole tools including aligning a releasable tool with a quick change sub, activating a motor in a first direction to capture the quick change sub with a plurality of arms, detecting the travel of the plurality of arms, and confirming that the plurality of arms have traveled sufficiently to lock the releasable tool to the quick change sub. It may further include lowering the releasable tool into a wellbore. It may include pulling up on the releasable tool while it is in the wellbore. It may include activating the motor in a second direction to release the plurality of arms from the quick change sub. It may include detecting the travel of the plurality of arms when releasing the quick change sub. It may include confirming that sufficient travel of the plurality of arms has occurred, wherein the releasable tool is fully released from the quick change sub. It may include removing the releasable tool from the wellbore. It may include lowering a retrieving tool into the borehole to retrieve the quick change sub and any tool string located downhole of and couple to the quick change sub.

An example embodiment may include a releasable tool system including a first cylindrical housing comprising a motor coupled to a super nut, in which the super nut converts rotation motion into a set linear travel from a first stop to a second stop, an indicator switch coupled to the super nut, in which the indicator switch can detect when the super nut has reached the first stop or the second stop, a second cylindrical housing located downhole of, and proximate to, the first cylindrical portion housing a push rod coupled to a collet, wherein the push rod is further coupled to the super nut, the collet further having a first conical portion and a second conical portion connected by a cylindrical body, in which the slant of the first conical portion and the second conical portion face towards each other, at least one collet arm pivoting about a pin located within the second cylindrical body and having a rocker arm with a first contact area, a second contact area, and a lever grip, in which the first contact area is located proximate to the first conical portion, the second contact area is located proximate to the second conical portion, and the pivot point is located in between the first conical portion and a the second conical portion of the collet, a cylindrical quick change sub with a narrow neck portion located within the second housing, in which the lever grip of the at least one collet arm engages with the narrow neck portion.

The example embodiment may include one or more of the following, a screw coupling the motor to the super nut, a plurality of bearings on the screw, at least one collet cutout in the second cylindrical portion corresponding to the at least one collet arm, an umbilical electrical cord connected to the second cylindrical portion using a feed thru connector, a guide cutout in the first cylindrical portion for the indicator switch to travel along, a third cylindrical portion that slides over the second cylindrical portion, having an umbilical cord slot and a plurality of pressure equalizing vents, an electronic housing with an electronics board located proximate to and uphole from the first cylindrical housing, or at least one or more perforating guns coupled downhole from and proximate to the quick change sub. The at least one collet arm may be a plurality of collet arms located evenly about the center axis of the collet. The releasable tool may be conveyed downhole on a wireline.

BRIEF DESCRIPTION OF THE DRAWINGS

For a thorough understanding of the present invention, reference is made to the following detailed description of the preferred embodiments, taken in conjunction with the accompanying drawings in which reference numbers designate like or similar elements throughout the several figures of the drawing. Briefly.

DETAILED DESCRIPTION OF EXAMPLES OF THE INVENTION

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

Figure 1:
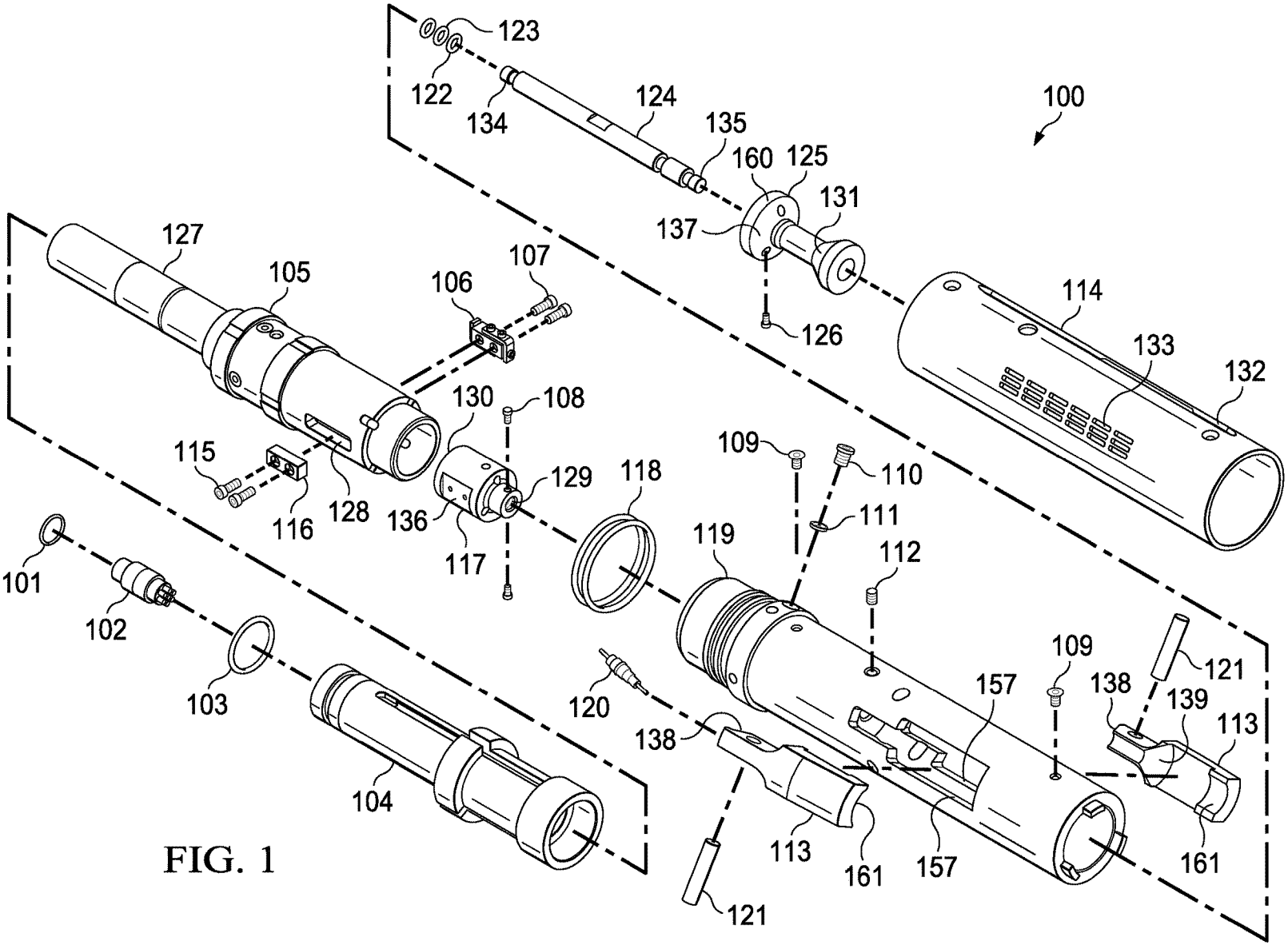
FIG. 1 depicts an exploded view of an assembly of an example embodiment.

An example embodiment is shown in FIG. 1 of a release tool 100. The collet drive assembly 100 includes a motor 127 housed in a motor housing 104 and coupled to a drive housing 105. A super nut 117 is slideably engaged with the inner bore of the drive housing 105. The drive housing 105 has a guide slot 128, a guide block 116 is secured to the super nut 117 via screws 115. The uphole end of the guide slot 128 acts as a first stop, indicating the super nut 117 has bottomed out in the uphole direction. The downhole end of the guide slot 128 acts as a second stop, indicating that the super nut 117 has bottomed out in the downhole direction. The super nut 117 is prevented from rotating due to the guide block 116 acting in the guide slot 128 and it can move laterally, bound by the first stop and the second stop of guide slot 128. The drive housing 105 has a second slot, not shown, that allows indicator switch 106 to be coupled to the super nut 117. The super nut 117 has internal fine threads 129 on one side and internal course threads 130 on the opposite side. The drive housing 105 couples to the collet sub 119. The collet sub has two cutouts 157 adapted to allow the installation of collets 113. Retaining cover 114 slides over collet sub 119. The retaining cover 114 has an umbilical slot 132 and pressure equalizing vents 133. A push rod 124 has a first end having exterior fine threads 134 adapted to thread into the internal fine threads 129 of super nut 117. The push rod 124 has a second end having threads 135 for engaging to the inner threads of the collet 125. O-rings 118 are used to seal the electronics in the outer housing of the electronics module. Feed thru pin 120 connects to an electrical connection within the collet sub 119 and allows an umbilical wire to run from the feed thru pin 120, along the umbilical slot 132, and into another feed thru pin not shown in this FIG. 1. The feed thru pins linked via an umbilical wire allows an electrical connection to pass through the collet sub 119 to additional tools further downhole in a tool string. If the release tool releases an attached downhole tool string then the umbilical will separate at the feed thru pin. In this example embodiment there are two collet arms 113, however there may a plurality of collet arms of two or more.

O-rings 110 and 111 combine with screw 109 to hold the retaining cover 114 in place. Screws 112 and 109 are used to couple the retaining cover 114 over the collet sub 119. O-ring 123 and backup ring 122 are coupled to the fine threaded end of the push rod 124. Retaining screw 126 fixes collet 125 to the threads 135 of the push rod 124 to prevent rotation. The cylindrical outer edge 160 provides a surface for the collets to positively hold against using a hanging end.

During operation power is provided via the HP/HT connector 102, which is sealed with o-rings 101 and 103 into the motor housing 104. As the motor 127 spins it uses a gear reduction to provide low speed and high torque. The gear box has a splined output that engages a screw with exterior course threads. The course threads of the screw (not shown) engage with the internal course threads 130 of the super nut 117. As the screw turns it causes the super nut 117 to translate forward or backward within the drive assembly housing 105. This lateral movement can be detected by the indicator switch 106 that is fastened to the super nut 117 using screws 107. As the indicator switch 106 travels in its slot in the drive assembly housing 105, it can detect whether it has fully stopped forward, backwards, or if it is in between. This fully stopped signal will be used by the tool electronics to deactivate the motor 127. Fully stopped forward, or downhole, or the second stop, corresponds to the collet arms 113 being fully engaged. Fully stopped backwards, or uphole, or the first stop, corresponds to the collet arms 113 being fully released.

The combination of super nut 117 and motor 127 acts as a linear actuator or linear step motor. A linear actuator operates by rotating an electric motor, which may include a stepper motor, and converts the rotation into linear actuation. Typically a screw from the motor engages a nut, the nut is then physically restrained from rotating, but allowed to move linearly. This nut, which is referred to as a super nut in this application, will then move linearly in some proportion to the number of turns of the motor as determined by the threads used to couple the nut with the screw and the gear reduction. The nut may be constrained with a captive shaft screw, an external screw, or in this case a guide block 116 screwed externally onto the nut and sliding in a guide slot 128. The super nut 117 is responsible for converting the rotational torque output from the motor 127 into a linear force to move push rod 124 uphole or downhole. The super nut 117 has a flat surface 136 for mounting the guide 116 via fasteners 115. There is a second flat surface, located 180 degrees about the axis from the first flat surface 136, which is mounted to the indicator switch assembly 106, held in place via fasteners 107. Fasteners 108 secure the super nut 117 fine threads 129 to the fine threads 134 of the push rod 124. The movement of the super nut 117 causes lateral movement in the push rod 124, which causes movement in the collet 125. As the collet 125 moves downhole laterally, the first inner conical surface 137 pushes against the outer angled end 138 of the collet arms 113. This downhole movement forces the collet arms 113, which are pinned via pin 121 between the outer angled end 138 and the inner angled end 139, to rotate inwards about the pins 121, which engages the grip ends 161 with the quick change sub or upper body of a tool string being coupled to the release tool 100. Uphole movement of the collet 125 will cause the second inner conical surface 131 to engage the inner angled ends 139 of the collets 113, thereby causing the collets 113 to rotate outwards about the pins 121, corresponding to the collet arms being released. This release action disengages the grip ends 161 from the quick change sub or upper portion of a tool string coupled downhole from the release tool 100.

Figure 2:
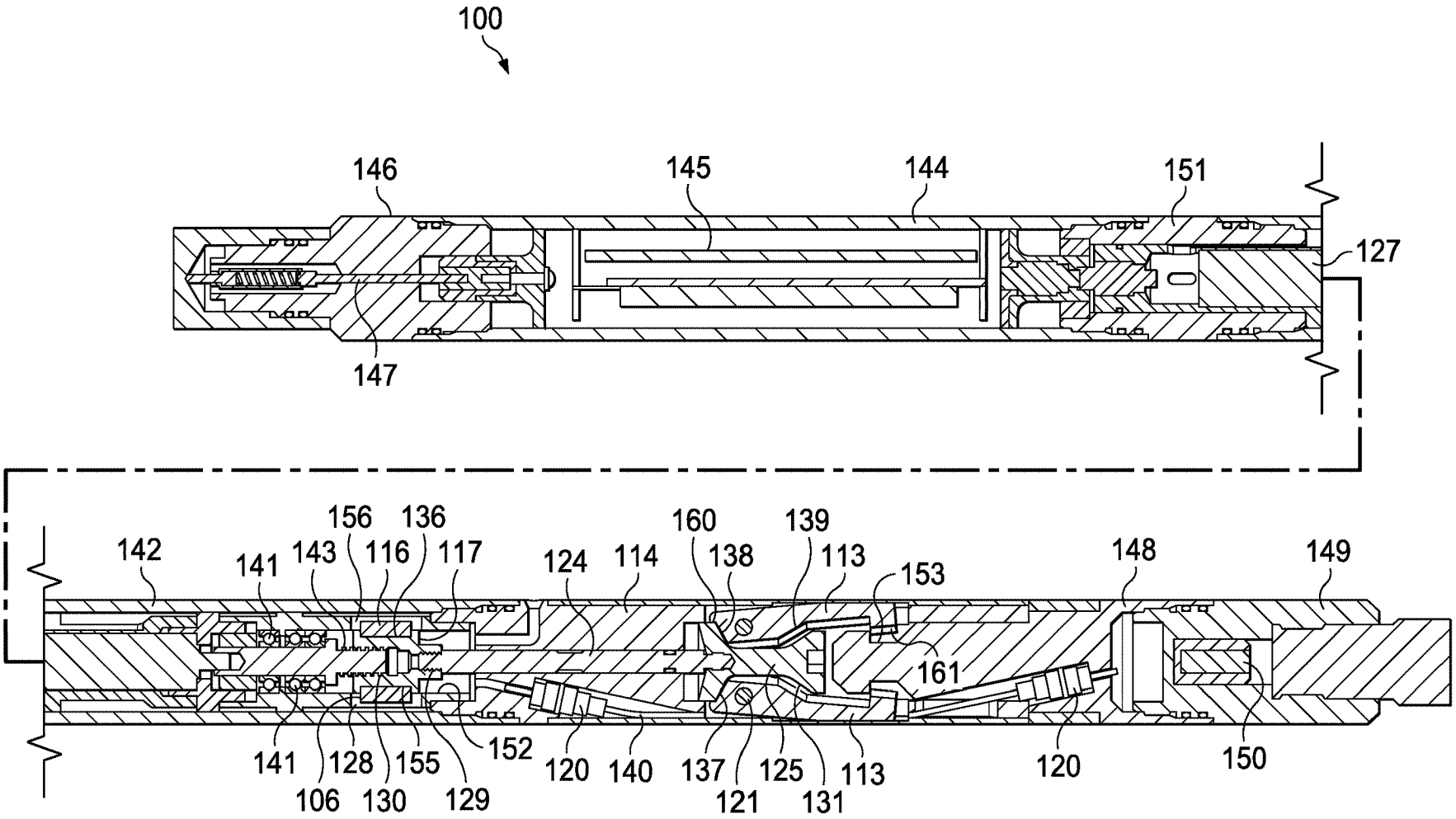
FIG. 2 depicts a side view of an assembly of an example embodiment.

An example embodiment is depicted in FIG. 2 showing a side cross section view of an assembled release tool 100. Top sub 146 is coupled to electronic housing 144. Electronics board 145 is located within the electronic housing 144. An electrical contact pin 147 provides an electrical signal through the top sub 146 and into the electronic housing 144. The metal exterior of the electronic housing 144 and all of the other exterior metallic portions provide the ground for any electrical signals. Connecting sub 151 couples the electronic housing 144 with the motor housing 142. The motor 127 is located within the motor housing 144. The motor 127 is coupled to the screw 143 via a spline interface. The bearings 141 hold the screw 143 in place. Screw 143 is coupled to the super nut 117 via coarse threads 130. As the motor 127 turns it causes the super nut to move laterally within the bore 152. Push rod 124 is threaded into the super nut 117 via fine threads 129. Push rod 124 is coupled to collet 125. Collet 125 causes the collet arms 113 to pivot or rotate inward or outward about pin 121.

Still referring to FIG. 2, when the motor 127 spins, it causes the collet 125 to move laterally downhole or uphole. When the collet 125 moves upwards, or uphole, or left in FIG. 2, the second inner conical surface 131 engages with the inner angled end 139 of the collet arms 113, causing the collet arm 113 to rotate outwards about the pin 121. When the collet 125 moves downwards, or downhole, or right in FIG. 2, the first inner conical surface 137 pushes against the outer angled end 138, causing the collet arms 113 to rotate inwards about pin 121. Movement downhole by the collet 125 will cause the end of the collet arms 113 to lock against the cylindrical surface 160, thus creating positive locking that prevents the collet arms 113 from releasing while the collet 125 is in its furthest downhole position. As the collet arms 113 rotate inward, the grip ends 161 engage with the neck 153 of the quick change sub 148. The guide block 116 can be seen mounted to a flat surface 136 of the super nut 117 and slideably engaged with the guide slot 128. The indicator switch 106 can be seen engaged to a flat surface 155 and slideably engaged with the guide slot 156. The uphole end, or left side, of guide slots 136 and 155 correspond to a first stop, or fully released collet arms 113. The downhole end, or right side, of the guide slots 136 and 155 correspond to a second stop, or fully engaged collet arms 113.

An umbilical 140 provides an electrical connection around the collet mechanism and is engaged on either end by feed thru connections 120. An electrical contact 150 in sub 149 provides the continuity of the electrical signal to subsequent downhole tools, such as perforating guns. The umbilical connection is breakable if the release tool must release the collet arms 113.

Figure 3A:
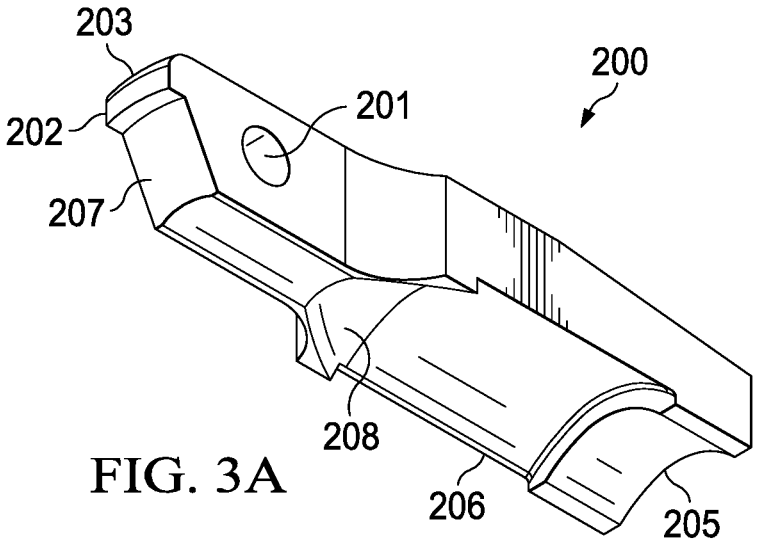
FIG. 3A depicts an underside view of a collet arm.

Referring to FIG. 3A, the collet arm 200 has a thru hole 201 for a pin to rotate about. The grip end 205 is a raised portion, cylindrical portion that is stepped from the partial cylindrical main body 206. The grip end 205 is adapted to engage the neck portion of a quick change sub. The outer angled end 207 is adapted to engage a conical portion of a collet and rotate the collet arm 200 inwards about the thru hole 201. The inner angled end 208 is adapted to engage a conical portion of a collet and rotate the collet arm 200 outwards about the thru hole 201. The hanging end 202 slips over a collet and provides positive locking force with the collet arms fully rotated inwards and engaged against a quick change sub neck. The hanging end 202 hangs over the edge of a conical portion of a collet where the collet has a cylindrical surface. The fillet portion 203 allows the edge of the collet arm 200 to slide into the cutouts of the collet sub.

Figure 3B:
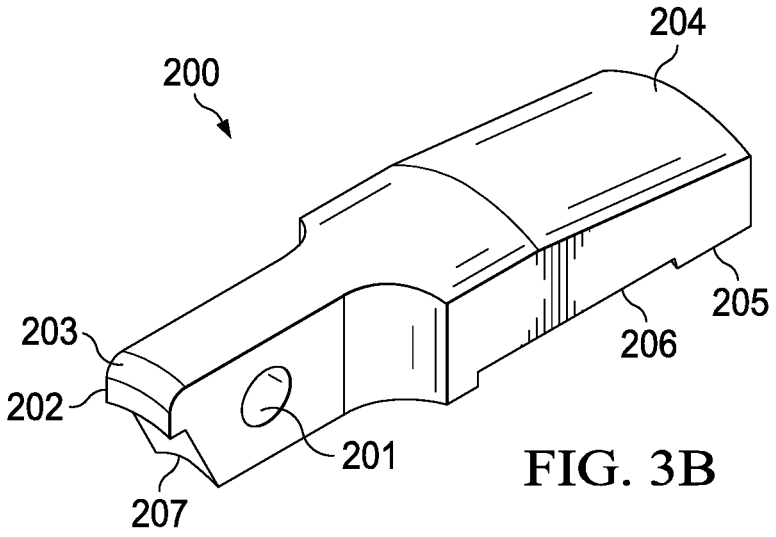
FIG. 3B depicts an over the top view of a collet arm.

Referring to FIG. 3B, the collet arm 200 has a thru hole 201 for a pin to rotate about. The grip end 205 is a raised portion, cylindrical portion that is stepped from the partial cylindrical main body 206. The grip end 205 is adapted to engage the neck portion of a quick change sub. The outer angled end 207 is adapted to engage a conical portion of a collet and rotate the collet arm 200 inwards about the thru hole 201. The upper cylindrical portion 204 is substantially the same radius as the collet sub, allowing the collet arm 200 to fit inside the cutouts and maintain the outer cylindrical dimensions of the collet sub. The hanging end 202 slips over a collet and provides positive locking force with the collet arms fully rotated inwards and engaged against a quick change sub neck. The hanging end 202 hangs over the edge of a conical portion of a collet where the collet has a cylindrical surface. The fillet portion 203 allows the edge of the collet arm 200 to slide into the cutouts of the collet sub.

Figure 4:
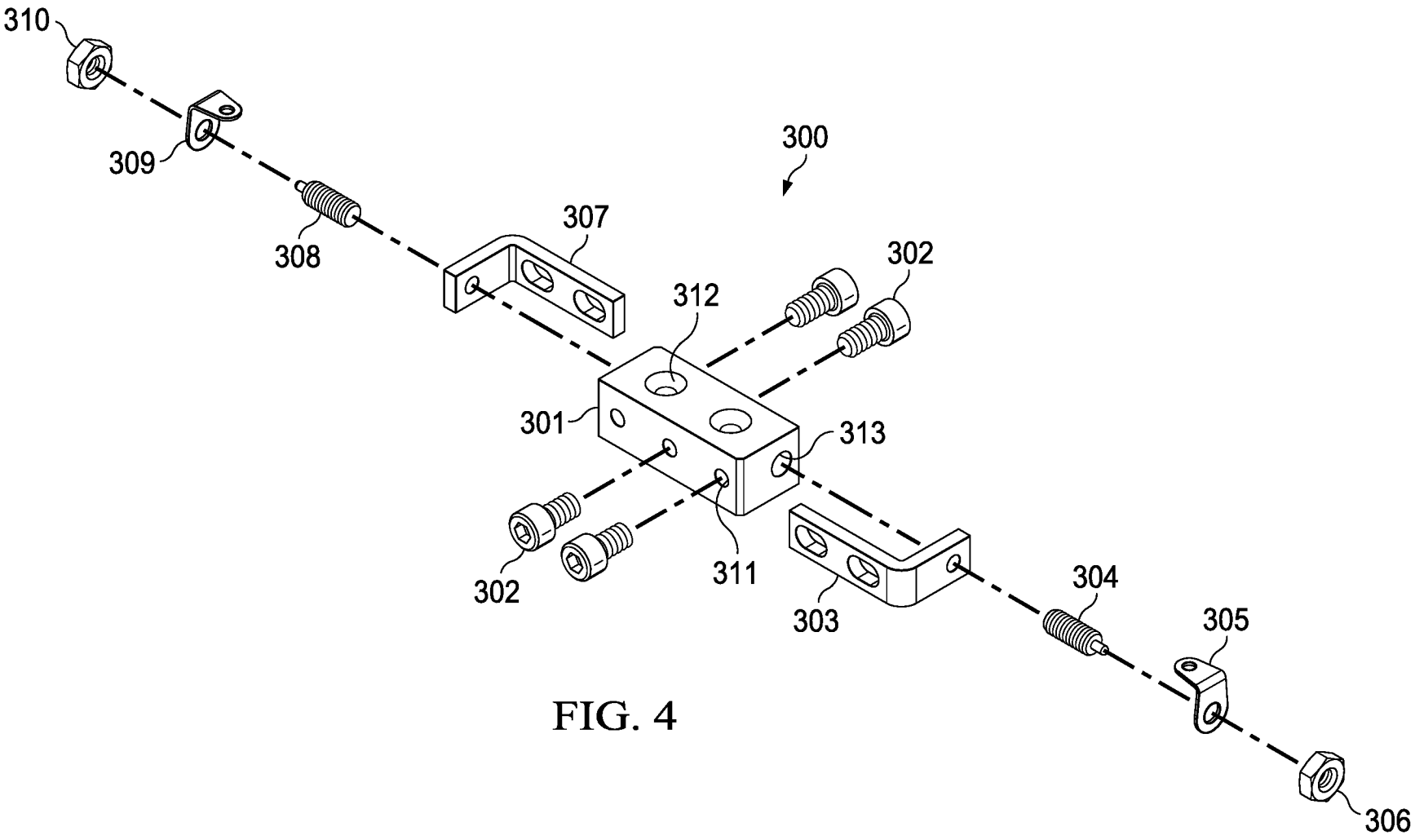
FIG. 4 depicts an exploded view of an indicator switch assembly.

An example embodiment of an indicator switch assembly 300 is shown in FIG. 4. The main body 301 houses the spring loaded indicator switch. The switch assembly can detect contact on two ends. The first end has a spring plunger 304, located with an L-bracket 303, with a solder lug 305 being held against the L-bracket 305 by nut 306. The second end has a spring plunger 308, located with an L-bracket 307, with a solder lug 309 being held against the L-bracket 307 by nut 310. Screws 302 couple the L-brackets 303 and 307 to the main body 301. As the switch assembly 300 slides down a switch slot in the drive assembly housing, the switch assembly 300 will detect when it has bottomed out on the downhole side of the slot, corresponding to the collet arms being fully engaged with the quick change sub. If it detects bottoming out on the uphole side of the slot, this corresponds to the collet arms being fully released from the neck of the quick change sub. If neither plunger 304 or 308 is in contact then the operator of the tool will know that the collet is somewhere in the middle between fully released and fully engaged. Whether the collet arms are fully engaged or partially engaged will inform the operator on how to attempt to retrieve the tool string. Spring plunger 304 screws into hole 313. Holes 312 are used to couple the indicator switch assembly 300 to a super nut on a linear actuator. Screws 302 screws into holes 311.

One of the potential benefits in using an electronically releasable tool is that an operator does not have to break a wireline connection when pulling up on a stuck tool and then fish out the broken wireline. Instead, the operator could simple decide to release the tool based on the amount of tension already in the wireline, without shearing any component. The releasable tool can then release from the stuck tool string, thus preserving the wireline. Afterwards a retrieve tool, such as an overshot style fishing tool (a tool that grabs the stuck tool) or wash-over tool (a pipe that covers a portion or all of the stuck tool string) as examples, may be used to retrieve the stuck tool string. Since the operator will have a positive signal from the indicator switch that the collet arms are fully engaged, fully disengaged, or neither, the operator will be able to make a more informed decision on how to remove a stuck tool string.

Although the invention has been described in terms of embodiments which are set forth in detail, it should be understood that this is by illustration only and that the invention is not necessarily limited thereto. For example, terms such as upper and lower or top and bottom can be substituted with uphole and downhole, respectfully. Top and bottom could be left and right, respectively. Uphole and downhole could be shown in figures as left and right, respectively, or top and bottom, respectively. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. The first housing and second housing may be top housing and bottom housing, respectfully. Terms like wellbore, borehole, well, bore, oil well, and other alternatives may be used synonymously. Terms like tool string, tool, perforating gun string, gun string, or downhole tools, and other alternatives may be used synonymously. The alternative embodiments and operating techniques will become apparent to those of ordinary skill in the art in view of the present disclosure. Accordingly, modifications of the invention are contemplated which may be made without departing from the spirit of the claimed invention.

What is claimed is:

1. An apparatus for joining and releasing downhole tools comprising:

a first cylindrical portion housing a motor coupled to a super nut, wherein the super nut converts rotation motion into a set linear travel from a first stop to a second stop;

an indicator switch coupled to the super nut, wherein the indicator switch can detect if the super nut has reached the first stop or the second stop;

a second cylindrical portion located downhole of, and proximate to, the first cylindrical portion housing a push rod coupled to a collet, wherein the push rod is further coupled to the super nut;

the collet further comprising a first conical portion and a second conical portion connected by a cylindrical body, wherein the tapered end of the first conical portion and the tapered end of the second conical portion face towards each other;

at least one collet arm pivoting about a pin located within the second cylindrical portion and having a rocker arm with a first contact area, a second contact area, and a lever grip, wherein the first contact area is located proximate to the first conical portion, the second contact area is located proximate to the second conical portion, and the pivot point is located in between the first conical portion and a the second conical portion of the collet.

2. The apparatus of claim 1 further comprising a screw coupling the motor to the super nut.

3. The apparatus of claim 1 wherein the at least one collet arm is a plurality of collet arms located evenly about the center axis of the collet.

4. The apparatus of claim 1 further comprising at least one collet cutout in the second cylindrical portion corresponding to the at least one collet arm.

5. The apparatus of claim 1 further comprising feed thru connector coupled to the second cylindrical portion and an umbilical electrical cord connected to feed thru connector.

6. The apparatus of claim 1 comprising a guide cutout with in the first cylindrical portion, having the first stop and second stop, for the indicator switch to travel along.

7. The apparatus of claim 1 further comprising a third cylindrical portion that slides over the second cylindrical portion, having an umbilical cord slot and a plurality of pressure equalizing vents.

8. The apparatus of claim 1 wherein the super nut is restricted from rotating and is free to slide axially.

9. A release tool for use in tool strings in oil wells comprising:

a drive unit including a motor and a super nut wherein the drive unit is adapted to translate the super nut axially in response to rotation of the motor;

a collet assembly including a plurality of collet arms pivotably affixed to a collet housing and a tapered inner collet shaft;

a sensor adapted to detect the position of the super nut at both extremities of its axial movement;

wherein the axial translation of the super nut in a first direction results in axially translating the tapered inner collet shaft axially in the first direction resulting in opening the collet arms and axial translation of the super nut in a second direction results in axially translating the tapered inner collet shaft axially in the second direction resulting in closing the collet arms.

10. The apparatus of claim 9 further comprising a screw coupling the motor to the super nut.

11. The apparatus of claim 9 further comprising a collet housing encompassing the collet assembly.

12. The apparatus of claim 9 further comprising a detachable umbilical electrical cord located proximate to the collet assembly.

13. The apparatus of claim 9 wherein the super nut is a linear actuating nut that is restricted from rotating axial and free to move linearly.

14. The apparatus of claim 9 further comprising an indicator switch coupled to the super nut, wherein the indicator switch can detect when the super nut has reached either of the axial extremities of its axial movement.

15. The apparatus of claim 9, the plurality of collet arms further comprising at least one collet arm pivoting about a pin located within the second cylindrical body and having a rocker arm with a first contact area, a second contact area, and a lever grip at the end of the collet arm.

16. A method for joining and releasing downhole tools comprising:

equalizing the pressure within a releasable tool;

aligning the releasable tool with a quick change sub;

activating a motor in a first direction to engage the releasable tool with the quick change sub with a plurality of arms;

detecting engagement of the plurality of arms to lock the releasable tool to the quick change sub;

releasing the quick change sub;

detecting the plurality of arms is not fully engaged; and detecting the plurality of arms is fully disengaged.

17. The method of claim 16 further comprising lowering the releasable tool into a wellbore.

18. The method of claim 16 further comprising pulling up on the releasable tool while it is in the wellbore.

19. The method of claim 16 further comprising activating the motor in a second direction to release the plurality of arms from the quick change sub.

20. The method of claim 19 further comprising detecting the travel of the plurality of arms when releasing the quick change sub.

21. The method of claim 20 further comprising confirming that sufficient travel of the plurality of arms has occurred, wherein the releasable tool is fully released from the quick change sub.

22. The method of claim 21, further comprising removing the releasable tool from the wellbore.

* * * * *